US010393321B2

(12) United States Patent
Wan et al.

(10) Patent No.: US 10,393,321 B2
(45) Date of Patent: Aug. 27, 2019

(54) LED LIGHT BULB

(71) Applicant: ZHEJIANG SHENGHUI LIGHTING CO., LTD., Jiaxing (CN)

(72) Inventors: Yehua Wan, Jiaxing (CN); Linzhang Liu, Jiaxing (CN)

(73) Assignee: ZHEJIANG SHENGHUI LIGHTING CO., LTD., Jiaxing (CN)

( * ) Notice: Subject to any disclaimer, the term of this patent is extended or adjusted under 35 U.S.C. 154(b) by 0 days.

(21) Appl. No.: 15/772,449

(22) PCT Filed: Jun. 29, 2017

(86) PCT No.: PCT/CN2017/090696

§ 371 (c)(1),
(2) Date: Apr. 30, 2018

(87) PCT Pub. No.: WO2018/001290

PCT Pub. Date: Jan. 4, 2018

(65) Prior Publication Data

US 2018/0320829 A1 Nov. 8, 2018

(30) Foreign Application Priority Data

Jun. 30, 2016 (CN) ..... 2016 1 0526917

(51) Int. Cl.
*F21V 29/00* (2015.01)
*F21K 9/232* (2016.01)
(Continued)

(52) U.S. Cl.
CPC ..... *F21K 9/232* (2016.08); *F21K 9/238* (2016.08); *F21V 3/061* (2018.02); *F21V 29/70* (2015.01);
(Continued)

(58) Field of Classification Search
CPC ..... F21K 9/232; F21V 29/004; F21V 29/74; F21V 29/773; F21V 29/70
See application file for complete search history.

(56) References Cited

U.S. PATENT DOCUMENTS 9,803,848 B2 * 10/2017 Van Hout ..... F21V 3/061
9,863,624 B2 * 1/2018 Rao ..... F21V 29/503
2006/0193130 A1 * 8/2006 Ishibashi ..... F21V 29/67 362/227
2012/0169251 A1 * 7/2012 Lai ..... F21K 9/90 315/294
(Continued)

FOREIGN PATENT DOCUMENTS

CN 103423646 A 12/2013
CN 103672526 A 3/2014
(Continued)

OTHER PUBLICATIONS

The World Intellectual Property Organization (WIPO) International Search Report and Written Opinion for PCT/CN2017/090696 dated Oct. 9, 2017 12 Pages.

*Primary Examiner* — Andrew J Coughlin
(74) *Attorney, Agent, or Firm* — Anova Law Group, PLLC

(57) ABSTRACT

An LED light bulb comprises at least one LED light source; a driver arranged in an electrical connection with the LED light source to drive and control the LED light source to emit light; a base electrically connecting the driver to an outside power source; a heat sink provided to dissipate heat generated by the LED light source, having a supporting portion to receive and support the LED light source; a housing joined to the base to accommodate the LED light source, the heat sink and the driver to integrate as a whole. The present disclosure provides an LED light bulb which has an appearance of the traditional incandescent light bulb.

16 Claims, 6 Drawing Sheets

(51) Int. Cl.

| | |
|---|---|
| ***F21V 29/70*** | (2015.01) |
| ***F21K 9/238*** | (2016.01) |
| ***F21V 3/06*** | (2018.01) |
| *F21V 29/85* | (2015.01) |
| *F21V 29/87* | (2015.01) |
| *F21V 29/89* | (2015.01) |
| *F21Y 115/15* | (2016.01) |
| *F21Y 107/40* | (2016.01) |
| *F21Y 107/70* | (2016.01) |

(52) U.S. Cl.
CPC ..... *F21V 29/86* (2015.01); *F21V 29/87* (2015.01); *F21V 29/89* (2015.01); *F21Y 2107/40* (2016.08); *F21Y 2107/70* (2016.08); *F21Y 2115/15* (2016.08)

(56) References Cited

U.S. PATENT DOCUMENTS

| | | | | |
|---|---|---|---|---|
| 2014/0126229 | A1* | 5/2014 | Hansen | F21V 23/005 362/382 |
| 2015/0009676 | A1* | 1/2015 | Danesh | F21S 8/02 362/296.01 |

FOREIGN PATENT DOCUMENTS

| | | | |
|---|---|---|---|
| CN | 104879661 | A | 9/2015 |
| CN | 105972461 | A | 9/2016 |
| CN | 106195679 | A | 12/2016 |
| CN | 205842277 | U | 12/2016 |
| CN | 205842279 | U | 12/2016 |
| EP | 2295849 | A1 | 3/2011 |

* cited by examiner

LED LIGHT BULB

CROSS-REFERENCE TO RELATED APPLICATION

This application is a national phase entry under 35 U.S.C. § 371 of International Application No. PCT/CN2017/090696, filed on Jun. 29, 2017, which claims priority of Chinese Patent Application No. 201610526917.4, filed on Jun. 30, 2016, the entire content of which is hereby incorporated by reference.

FIELD OF THE DISCLOSURE

The present disclosure relates to the field of the LED illumination technologies. In particular, it relates to an LED light bulb.

BACKGROUND

Many LED light bulbs have a look which is different from the traditional incandescent light bulbs. Most of the conventional LED light bulbs are in a semi-sphere configuration, due to the addition of a barrel-shaped heat sink arranged at one end. Compared to the traditional incandescent light bulbs, the heat sink of the conventional LED light bulb may occupy almost one-half of the volume size, leaving a smaller available space to build in other components. It thus brings the limitation to the structural design for the LED light source of the LED light bulb, causing difficulty in achieving wide-angle emission.

BRIEF SUMMARY OF THE DISCLOSURE

A housing of the disclosed LED light bulb is joined to a base to form a receiving space to accommodate a heat sink, an LED light source and other elements inside. This provides an LED light bulb which has a similar configuration and appearance of the traditional incandescence light bulb. The embodiments of the present disclosure provide design flexibility, facilitate wide-angle emission designs, and solves heat dissipation issues.

One aspect of the present disclosure provides an LED light bulb, comprising at least one LED light source including a plurality of LED chips; a driver arranged in an electrical connection with the LED light source to drive and control the LED light source to emit light; a base electrically connecting the driver to an outside power source; a heat sink provided to dissipate heat generated by the LED light source, comprising a supporting portion to receive and support the LED light source; and a housing joined to the base to accommodate the LED light source, the heat sink and the driver to integrate as the claimed LED light bulb. Further, the housing may be a glass bulb that diffuses light emitted from the LED light source. To improve the light diffusion effect and at the same time cover the heat sink and other components, the glass bulb may be a non-transparent glass bulb, such as a white glass bulb, a yellow glass bulb, etc.

In one embodiment of the present disclosure, the LED light source comprises a first LED strip and a second LED strip, wherein the first LED strip includes a first middle portion and first wings folded and positioned at two sides of the first middle portion, and the LED chips are provided on the first wings; the second LED strip includes a second middle portion and second wings folded and positioned at two sides of the second middle portion, and the LED chips are provided on the second wings; and the first LED strip and the second LED strip are stacked and electrically connected at the first and second middle portions.

Further, the first wings and the first middle portion are approximately perpendicular, and the second wings and the second middle portion are approximately perpendicular. In such an arrangement, the LED light source forms a rectangular prism, providing a wide-angle emission.

For better illumination, when the first LED strip and the second LED strip are stacked at the first and second middle portions, an uncovered middle portion is provided with the LED chips.

In one embodiment, the first LED strip is stacked on top of the second LED strip, and the first middle portion is provided with a hollow-out to expose the LED chips of the second middle portion at bottom. In such an arrangement, the middle portions are electrical connected and bring more LED chips for illumination.

Preferably, the first middle portion, the first wings, the second middle portion and the second wings are rectangular.

In one instance, the first LED strip further includes a first flexible circuit board, two sides of the first middle portion are spaced from the first wings, and the first middle portion and the first wings are connected by the first flexible circuit board. Similarly, the second LED strip further includes a second flexible board, two sides of the second middle portion are spaced from the second wings, and the second middle portion and the second wings are connected by the second flexible circuit board. The application of the flexible circuit boards establishes mechanical as well as electrical connections between the wings and the middle portions, and provides deformation flexibility.

Further, the supporting portion is a rectangular prism including at least two faces in contact with the LED light source for supporting the LED light source.

In order to connect the LED light source and the driver, a hole is provided in the body of the heat sink. The LED light source comprises a pin socket electrically connecting the LED chips, and the driver comprises pins so that the pins pass through the hole and are inserted into the pin socket for an electrical connection between the LED light source and the driver. In such an arrangement, soldering is not required.

In order to fasten and secure the driver, the heat sink further comprises two guiding grooves on an inner wall to receive and fasten two sides of the driver inside.

In order to avoid a short circuit between the driver and other elements, the LED light bulb further comprises a protection cover, wherein the protection cover includes a body and hook slots at two ends of the body, and two sides of the driver are inserted into the hook slots of the protection cover.

In order to enhance diffusion effect, the housing is non-transparent and made of glass. Further, the housing and the base are glued to combine.

In one instance, the heat sink is made of a thermal-conducting plastic, and the heat sink is joined to the base. In such an arrangement, the heat sink is supported by the base, and heat conducted through the heat sink travels to the base for heat dissipation.

In another instance, the LED light bulb further comprises an insulator disposed at one end of the heat sink, wherein the heat sink is made of a thermal-conducting metal, and the insulator and the base are joined. In such an arrangement, it provides an electrical insulation between the heat sink and the base to avoid a short circuit.

Further, the insulator and the heat sink are combined by a plastic-aluminum injection molding process. By means of such a process, it forms the insulator and heat sink as a whole, and heat conducted to the heat sink can travel to the insulator rapidly.

In embodiments of the present disclosure, the heat sink, the LED light source and other components are accommodated inside a housing which is joined to a base. The housing may be a glass bulb. The overall appearance of the LED light bulb is the same as, or substantially the same as the appearance of an incandescence light bulb. Accordingly, the present disclosure makes the structural design of the LED light source more flexible, easier to achieve wide-angle emitting design. The heat generated by the LED light source is thermally conducted to the base through the heat sink, thereby solving the heat dissipation problem. Meanwhile, the overall design is simple and easy to implement.

BRIEF DESCRIPTION OF THE DRAWINGS

The following drawings are merely examples for illustrative purposes according to various disclosed embodiments and are not intended to limit the scope of the present disclosure in any way.

DETAILED DESCRIPTION

Figure 1:
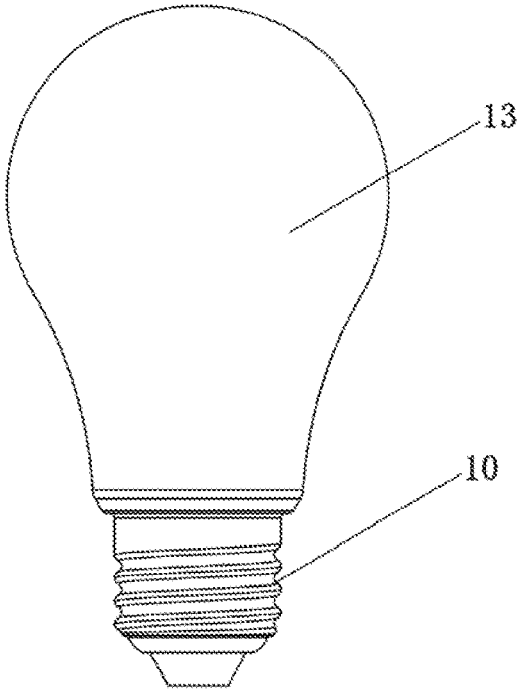
FIG. 1 is a front view of an LED light bulb consistent with the present disclosure.

Detailed descriptions and technical contents according to embodiments of the present disclosure will be described with regard to the accompanying drawings shown below. In addition, the drawings are not necessarily prepared in an actual proportion. It is apparent that the proportions of the drawings are not intended to limit the scope of the present disclosure as claimed.

As illustrated in FIGS. 1-7, one aspect of the present disclosure provides a Light Emitting Diode (LED) light bulb, which comprises a base 10, a heat sink 11, a driver 12, a housing 13 and at least one LED light source 50. The housing 13 is joined to the based 10 to form an inner space to accommodate the heat sink 11, the driver 12 and the LED light source 50. In consideration of enhancing diffusion reflection, the housing 13 may not be transparent and may be made of glass. For example, the housing 13 may be made of white glass, or glass of other colors. In one instance, the housing 13 and the base 10 are glued to combine. The driver 12 has an electrical connection with the LED light source 50 to drive and control the LED light source 50 to emit light. The LED light source 50 provides a light source. The housing 13 may be of any desirable shapes resembling the shapes of incandescence bulbs.

Figure 5:
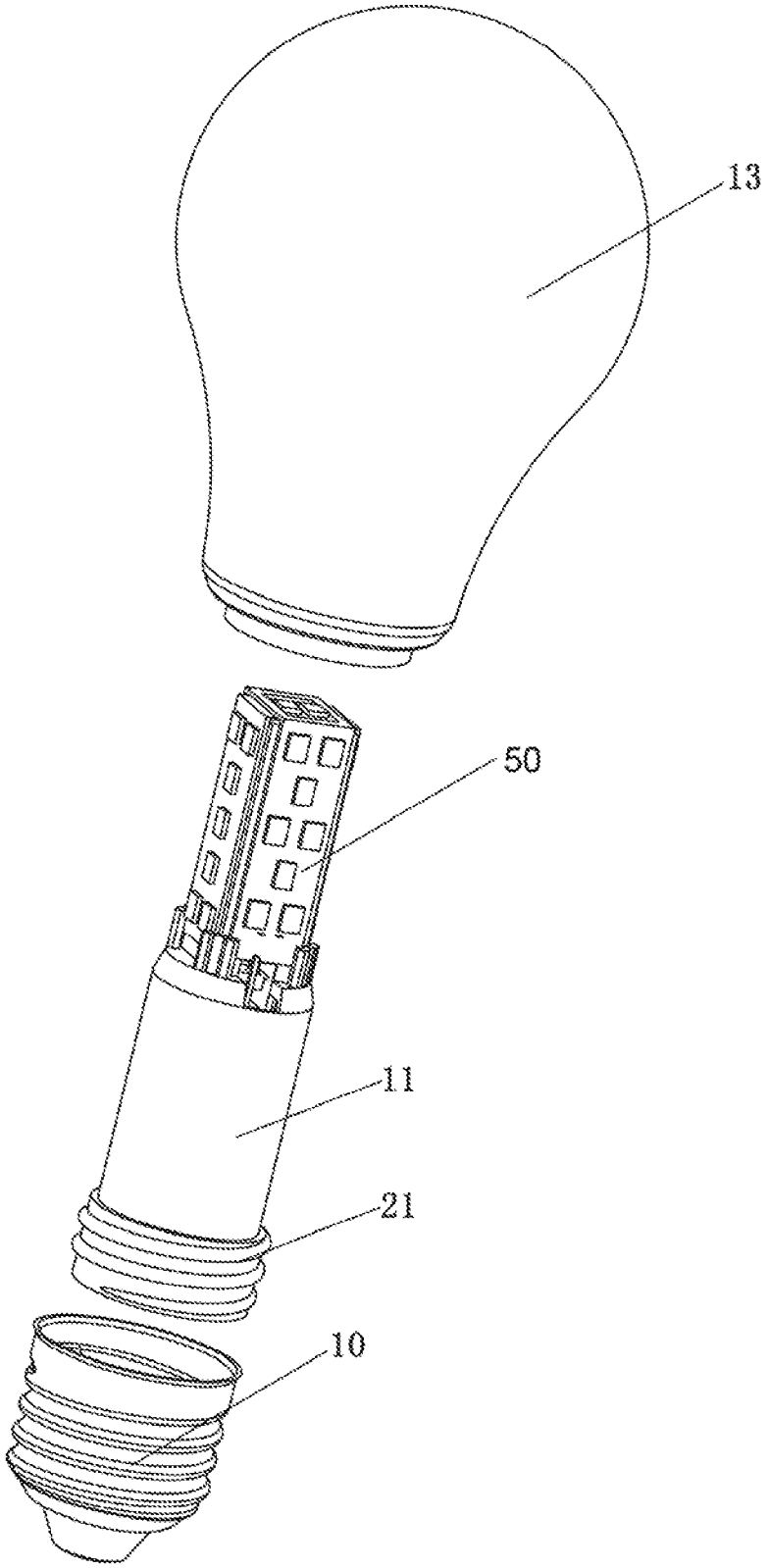
FIG. 5 is an exploded view of the LED light bulb consistent with the present disclosure.
Figure 6:
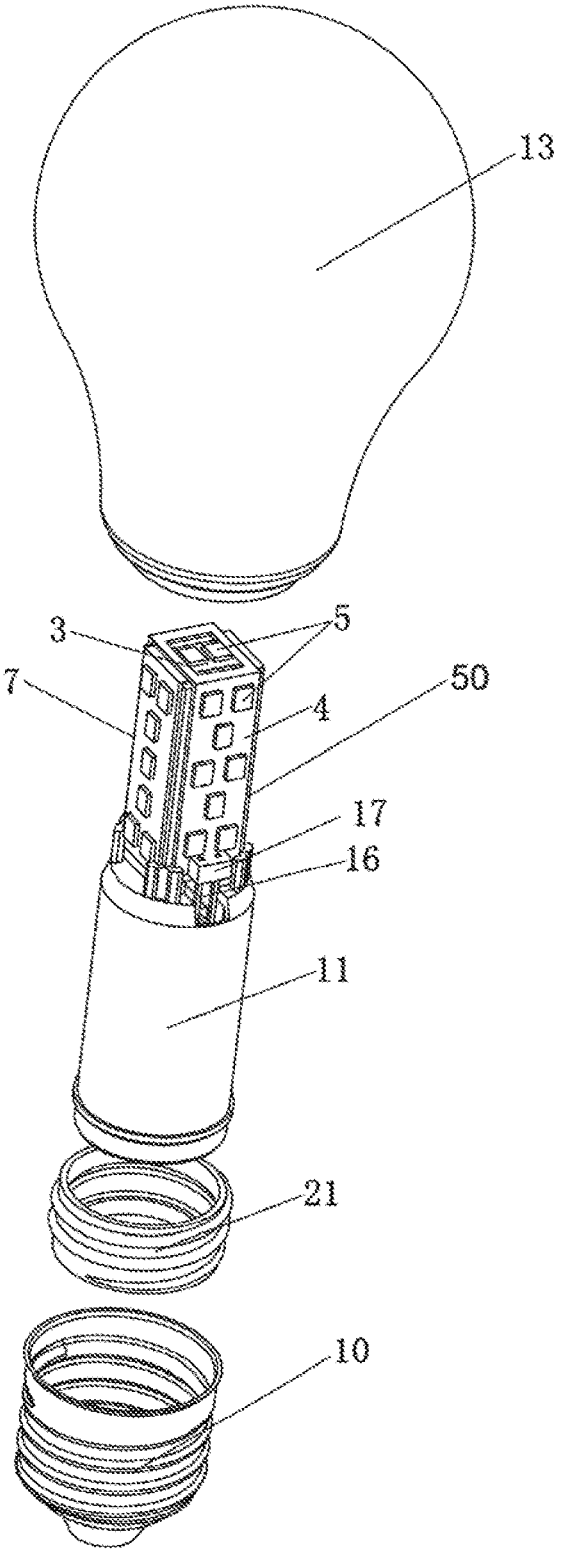
FIG. 6 is another exploded view of the LED light bulb shown in FIG. 5, from another angle.
Figure 7:
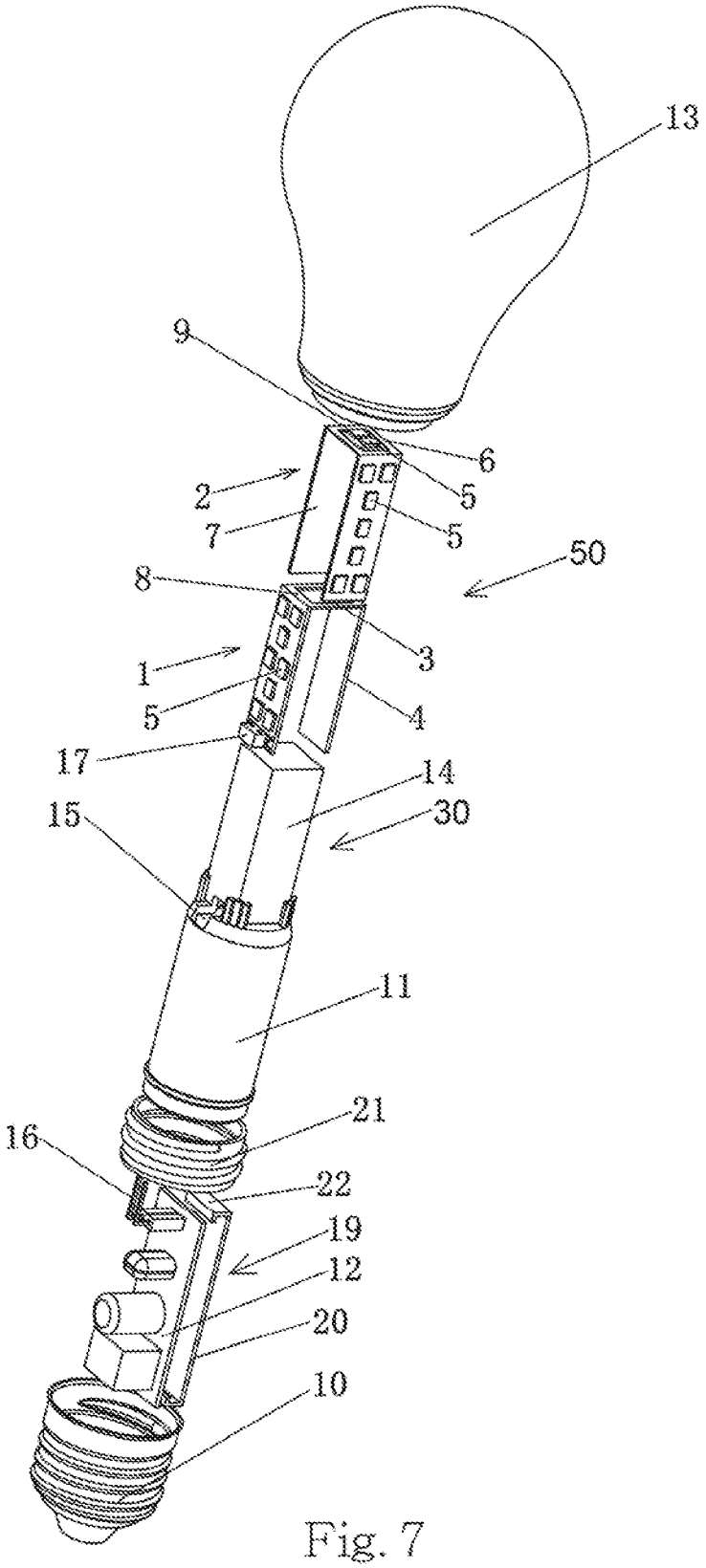
FIG. 7 is an exploded view of the LED light bulb consistent with the present disclosure.

In reference to FIGS. 5-7, the LED light source 50 comprises a first LED strip 1 and a second LED strip 2. The first LED strip 1 includes a first middle portion 3, first wings 4 and a first flexible circuit board 8. Preferably, the first wings 4 are folded and positioned symmetrically at two sides of the first middle portion 3. A plurality of LED chips 5 are provided on the first wings 4. The second LED strip 2 includes a second middle portion 6, second wings 7 and a second flexible circuit board 9, and a plurality of LED chips 5 are provided on the second wings 7. Similar to the arrangement of the first wings 4, the second wings 7 are folded and positioned symmetrically at two sides of the second middle portion 6.

In one embodiment, the LED strip 1 and the second LED strip 2 are cross-stacked and electrically connected at the first middle portion 3 and the second middle portion 6. In one instance, the first middle portion 3 and the second middle portion 6 are connected by the process of spot welding.

In one instance, the first wings 4 and the first middle portion 3 are approximately perpendicular, while the second wings 7 and the second middle portion 6 are approximately perpendicular. When being stacked at the middle portions 3 and 6, an uncovered middle portion (either top or bottom) is provided with the LED chips 5 for more illumination. For instance, as shown in FIG. 6, when the first LED strip 1 is stacked on top of the second LED strip 2, the first middle portion 3 on top is provided with a hollow-out to expose the LED chips 5 of the uncovered second middle portion 6 at bottom for more illumination.

The middle portions 3 and 6 can be in a rectangular shape, and the wings 4 and 7 can also be in a rectangular shape. The LED chips 5 are provided on the flexible circuit boards 8 and 9 and disposed on the wings 4 and 7 and the uncovered middle portions 3 and 6. In one instance, the wings are formed by bending at two sides of middle portion and connected to the middle portion. In another instance, the middle portion and the corresponding wings are separated with a space and connected by the corresponding flexible circuit board. More specifically, two sides of the first middle portion 3 are spaced from the first wings 4, and the first middle portion 3 and the first wings 4 are connected by the first flexible circuit board 8. And two sides of the second middle portion 6 are spaced from the second wings 7, and the second middle portion 6 and the second wings 7 are connected by the second flexible circuit board 9. The LED chips 5 are disposed on the first flexible circuit board 8 and the second flexible circuit board 9 respectively.

Figure 4:
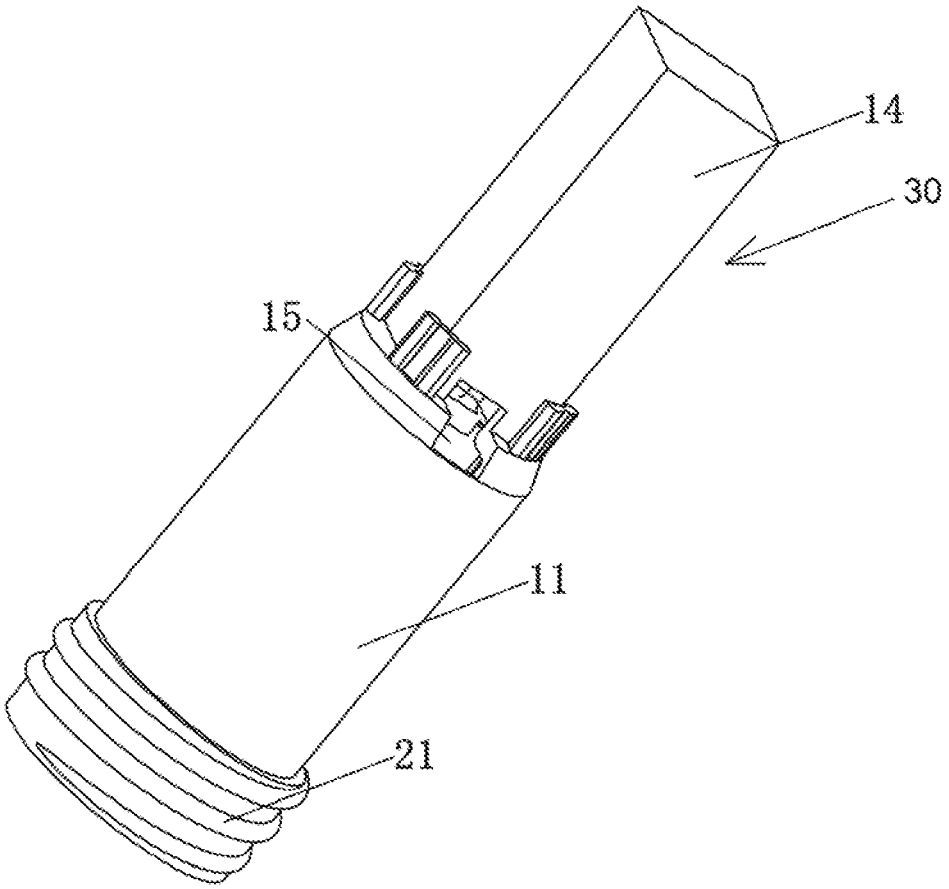
FIG. 4 is a perspective view of a heat sink having a supporting portion consistent with the present disclosure.

A body of the heat sink 11 is, in a cylindrical configuration, which is hollow. The driver 12 is a driver circuit board and is disposed inside the heat sink 11. As illustrated in FIG. 4, the heat sink 11 comprises a supporting portion 30 for receiving and supporting the LED light source 50. In one instance, the supporting portion 30 is hollow and has a configuration matching to that of the LED light source 50 for a fit. The LED light source 50 are shelved onto the supporting portion 30 of the heat sink 11 in assembly to provide a multi-faced lighting source.

More specifically, the heat sink 11 can be made of metal, ceramics, or plastic material of certain heat dissipation ability. In one instance, the heat sink 11 is made of aluminum, and the LED light bulb further comprises an insulator 21 disposed at one end of the heat sink 11. The insulator 21 is made of a thermal-conducting plastic. In one instance, the insulator 21 and the base 10 are screwed to combine to provide an electrical insulation between the heat sink 11 and the base 10. In this case, the insulator 21 and the heat sink 11 can be combined by a plastic-aluminum injection molding process. In another instance, the heat sink 11 is made of a thermal-conducting plastic, and the heat sink 11 can be directly joined to the base 10.

Preferably, the supporting portion 30 of the heat sink 11 is a rectangular prism. In this configuration, the supporting portion 30 includes a top face to contact and support the middle portions 3 and 6 of the LED light source 50, and at least one side face in contact with the wings 4 and 7. The side faces are comprised of four enclosing planes 14. In one embodiment, further, the wings 4 and 7 of the LED light source 50 are in contact with the corresponding planes 14.

As illustrated in FIGS. 4 and 7, a hole 15 is provided through the body of the heat sink 11, at the end of the supporting portion 30 remote from the LED light source 50. The driver 12 comprises pins 16, while the LED light source 50 comprises a pin socket 17 at an end adjacent to the driver 12. The pin socket 17 is disposed on one of the flexible circuit boards 8, 9 and electrically connects the LED chips 5. In one embodiment, the pins 16 of the driver 12 pass through the hole 15 and are inserted into the pin socket 17 of the LED light source 50 to establish an electrical connection between the driver 12 and the LED light source 50.

Figure 2:
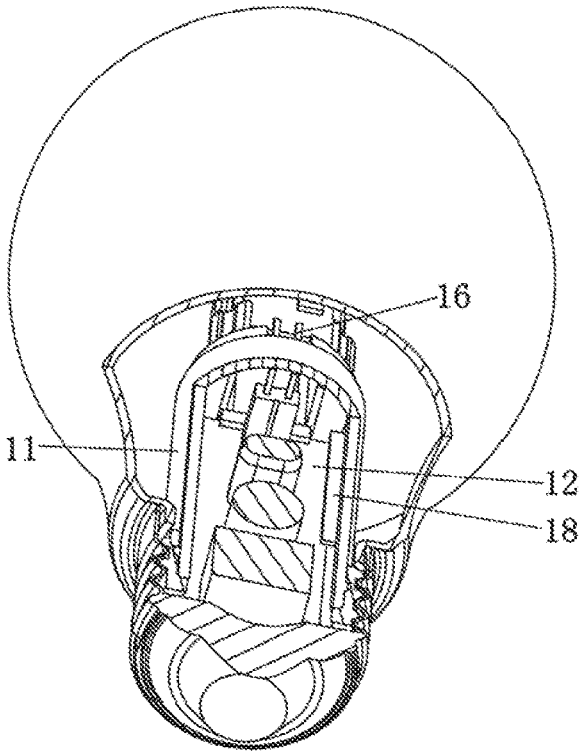
FIG. 2 is a partial cross-sectional view showing an internal structure of the LED light bulb in FIG. 1.

FIG. 2 is a cross-sectional view partially showing an internal structure of the LED light bulb. As illustrated, two guiding grooves 18 are provided on an inner wall of the heat sink 11. When the driver 12 is inserted into the heat sink 11, the guiding grooves 18 receive and fasten two sides of the driver 12 for an assembly. In one instance, the two guiding grooves 18 are symmetrically disposed inside the heat sink 11.

Figure 3:
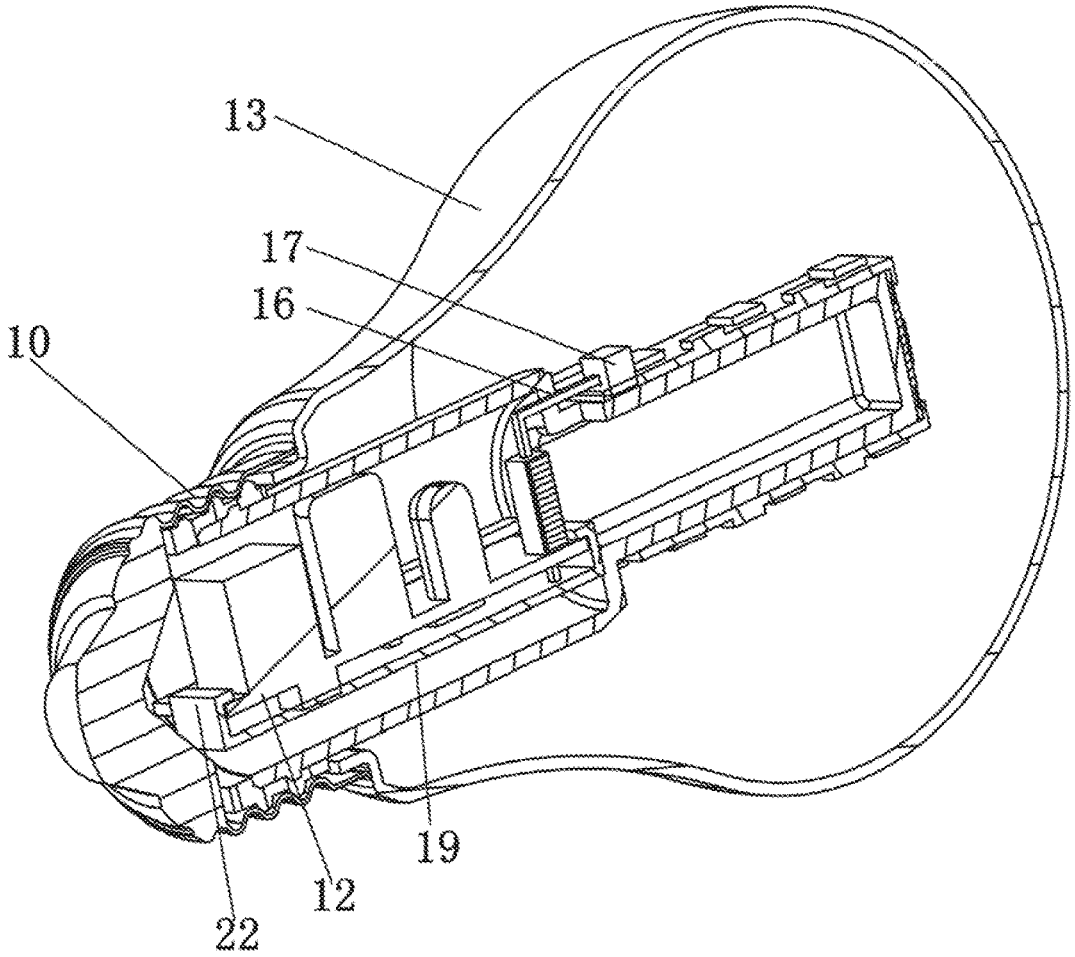
FIG. 3 is a cross-sectional view of the LED light bulb as shown in FIG. 1.

Moreover, as illustrated in FIGS. 3 and 7, the LED light bulb further comprises a protection cover 19 as provided to hook with the driver 12 for a protection. More specifically, the protector cover 19 comprises a body 20 and hook slots 22 at two ends of the body 20. From a side view, each of the hook slots 22 forms an L-shape. Two sides of the driver 12 are inserted into the hook slots 22 of the protection cover 19 for the protection.

In some embodiments, the LED light source 50 may include more than two LED strips. For example, the LED light source 50 may include three LED strips. Each LED strip includes two wings to hold the LED chips, and a middle portion similar to middle portions 3 or 6. The middle portions of the LED strips may be electrically connected. The middle portions of the LED strips may be fixed on the supporting portion 30 or the top face of the supporting portion 30. The supporting portion 30 may be a hexagonal shape, which provides supporting surfaces for the six wings of the three LED strips. In another example, the LED light source 50 may include four LED strips. Each LED strip includes two wings to hold the LED chips, and a middle portion similar to middle portions 3 or 6. The middle portions of the LED strips may be electrically connected. The middle portions of the LED strips may be fixed on the supporting portion 30 or the top face of the supporting portion 30. The supporting portion 30 may be an octagonal shape, which provides supporting surfaces for the eight wings of the three LED strips.

In some embodiments, the LED light source 50 may include straight LED wings/strips, curved wings/strips, or jagged wings/strips. In some embodiments, the supporting portion 30 may be of a cylinder or a cone shape. The LED wings 4 and 7 may be curvy strips and may be supported by the supporting portion 30.

While the present disclosure has been particularly described in terms of the various forms and examples, the forms and examples do not recite all details and should not be used to limit the present disclosure. They are applied for a better explanation. There might be alternative, modifications and variations. And it is to be understood that many alternatives, modifications and variations will be apparent to those skilled in the art in light of the foregoing description. It is therefore contemplated that the appended claims will embrace any such alternatives, modifications and variations as falling within the true scope and spirit of the present disclosure.

What is claimed is:

1. An LED light bulb, comprising:

at least one LED light source including a first LED strip and a second LED strip, each of the first LED strip and the second LED strip having a plurality of LED chips;

a driver arranged in an electrical connection with the LED light source to drive and control the LED light source to emit light;

a base electrically connecting the driver to an outside power source;

a heat sink provided to dissipate heat generated by the LED light source, comprising a supporting portion to support the LED light source; and a housing coupled to the base to accommodate the LEI) light source, the heat sink and the driver to integrate as the claimed LED light bulb, wherein:

the first LED strip includes a first middle portion and first wings folded and positioned at two sides of the first middle portion, and the plurality of LED chips are placed on the first wings, the second LED strip includes a second middle portion and second wings folded and positioned at two sides of the second middle portion, and the plurality of LED chips are placed on the second wings, and the first LED strip and the second LED strip are stacked and electrically connected at the first and second middle portions.

2. The LED light bulb according to claim 1, wherein the first wings and the first middle portion are approximately perpendicular, and the second wings and the second middle portion are approximately perpendicular.

3. The LED light bulb according to claim 1, wherein the first LED strip and the second LED strip are stacked at the first and second middle portions, and a middle portion is exposed and in contact with a LED chip.

4. The LED light bulb according to claim 3, wherein the first LED strip is stacked on top of the second LED strip, and the first middle portion includes a hollow-out to expose the LED chip of the second middle portion at bottom.

5. The LED light bulb according to claim 1, wherein the first middle portion, the first wings, the second middle portion and the second wings are rectangular.

6. The LED light bulb according to claim 1, wherein the first LED strip further includes a first flexible circuit board, two sides of the first middle portion are spaced from the first wings, and the first middle portion and the first wings are connected by the first flexible circuit board.

7. The LED light bulb according to claim 1, wherein the second LED strip further includes a second flexible board, two sides of the second middle portion are spaced from the second wings, and the second middle portion and the second wings are connected by the second flexible circuit board.

8. The LED light bulb according to claim 1, wherein the supporting portion is a rectangular prism including at least two faces in contact with the LED light source for supporting the LED light source.

9. The LED light bulb according to claim 1, wherein the heat sink has a hole in its body, the LEI) light source comprises a pin socket electrically connecting the LED chips, and the driver comprises pins so that the pins pass through the hole and are inserted into the pin socket to form an electrical connection between the LED light source and the driver.

10. The LED light bulb according to claim 1, wherein the heat sink further comprises two guiding grooves on an inner wall to receive and fasten two sides of the driver.

11. The LED light bulb according to claim 1, further comprising a protection cover, wherein the protection cover includes a body and hook slots at two ends of the body, and two sides of the driver are inserted into the hook slots of the protection cover.

12. The LED light bulb according to claim 1, wherein the housing is non-transparent and made of glass.

13. The LED light bulb according to claim 1, wherein the housing and the base are glued together.

14. The LED light bulb according to claim 1, wherein the heat sink is made of a thermal-conducting plastic, and the heat sink is joined to the base.

15. The LED light bulb according to claim 1, further comprising an insulator disposed at one end of the heat sink, wherein the heat sink is made of a thermal-conducting metal, and the insulator and the base are joined to provide an electrical insulation between the heat sink and the base.

16. The LED light bulb according to claim 15, wherein the insulator and the heat sink are combined by a plastic-aluminum injection molding process.

* * * * *